United States Patent [19]

Shozi et al.

[11] Patent Number: 4,776,283

[45] Date of Patent: Oct. 11, 1988

[54] TRUCK FOR RAILWAY VEHICLE

[75] Inventors: Takao Shozi, Kawasaki; Isao Okamoto, Musashino; Hideo Takai, Hikari; Motomi Hiraishi, Kudamatsu; Toshihiko Sunaseki, Yanai; Kastuyuki Terada, Kudamatsu; Tetsuji Hirotsu, Katsuta, all of Japan

[73] Assignee: Hitachi, Ltd., Tokyo, Japan

[21] Appl. No.: 930,533

[22] Filed: Nov. 14, 1986

Related U.S. Application Data

[63] Continuation of Ser. No. 722,677, Apr. 12, 1985, abandoned.

[30] Foreign Application Priority Data

Apr. 27, 1984 [JP] Japan ..... 59-84011

[51] Int. Cl.[4] ..... B61F 3/00; B61F 5/30; B61F 5/38; B61F 5/50

[52] U.S. Cl. ..... 105/224.1; 105/165; 105/222; 105/218.1

[58] Field of Search ..... 105/224.05, 224.06, 105/218.1, 224.1, 219, 220, 222, 165

[56] References Cited

U.S. PATENT DOCUMENTS

| | | | |
|---|---|---|---|
| 1,907,927 | 5/1933 | Wolfard | 105/224.1 |
| 3,394,662 | 7/1968 | Weber | 105/165 |
| 4,109,586 | 8/1978 | Briggs et al. | 105/222 X |
| 4,166,611 | 9/1979 | Geers et al. | 105/224.1 X |
| 4,589,317 | 5/1986 | Colford et al. | 105/224.1 |

FOREIGN PATENT DOCUMENTS

| | | | |
|---|---|---|---|
| 324971 | 11/1957 | Switzerland | 105/224.1 |
| 892671 | 11/1959 | United Kingdom | 105/218 |
| 935841 | 5/1960 | United Kingdom | 105/224.1 |
| 1508632 | 4/1978 | United Kingdom | 105/224.1 |
| 2023523 | 5/1979 | United Kingdom | 105/224.1 |

*Primary Examiner*—James B. Marbert
*Attorney, Agent, or Firm*—Antonelli, Terry & Wands

[57] ABSTRACT

In a truck for a railway vehicle having a plurality of wheels-and-axles, an arrangement is provided for permitting each wheel-and-axle an optimal steering operation when the truck runs on a curved track, and to simplify the construction of journal box locator. Each journal box is located and fitted to a truck frame by the journal box locator for locating and fitting the journal box to the truck frame in such a fashion that the orbit of movement of the journal box expands upward with respect to the center axis of the truck, and permits the relative displacement between the journal box and the truck frame by elastic deformation of elastic members.

3 Claims, 5 Drawing Sheets

TRUCK FOR RAILWAY VEHICLE

This is a continuation of application Ser. No 722,667, filed Apr. 12, 1985, now abandoned.

BACKGROUND OF THE INVENTION

The present invention relates to a truck for a railway vehicle and, more particularly, to a truck which is suitable for a railway vehicle running on a curved track at a high speed.

As shown in FIGS. 1, 2, 3 and 4, a conventional railway vehicle with a truck using rolling rubber springs for a journal box support device includes a car body 1, an air spring 2, and a truck frame 3, with the car body 1 being supported on the truck frame 3 by the air springs 2. A journal box locating means 4 locates and fits a journal box 5 to the truck frame 3, with the journal boxes 5 being disposed at both ends of a wheel-and-axle 6. The journal box locating means 4 locates the wheel-and-axle 6 to the truck frame 3 via the journal box 5, and buffers the relative displacement of the wheel-and-axle 6 to the truck frame 3 in the vertical direction. The journal box locating means 4 also restricts the movement of the wheel-and-axle 6 in both longitudinal and transverse directions within a horizontal plane relative to the truck frame 3.

As shown in FIGS. 3 and 4, the journal box locating means 4 includes a center core 11, a rubber ring 10 and an outer housing 9. The center cores 11 are disposed and fitted by nuts 7 to the journal box 5 in the longitudinal direction of the car body. The center core 11 is inserted into the rubber ring 10, and supports the outer housing 9 through the rubber ring 10. The outer housing 9 is fitted to the lower-surface of the truck frame 3 at the fitting position of the journal box. An axle box hanger is vertically disposed on the center of the journal box 5 and a hole is bored on the truck frame 3 so that the axle box hanger can be inserted therein. The axle box hanger is fitted to the truck frame 3 by a set metal 8 while it is kept inserted into the hole of the truck frame 3. The set metal 8 penetrates through an elongated hole disposed on the axle box hanger so that the latter can move vertically.

The journal box locating means 4 operates and functions in the following manner. The rubber ring 10 is interposed between the outer housing 9 and the center core 11. While being pushed by the relative displacement between the outer housing 9 and the center core 11 in the vertical direction and rolling, the rubber ring 10 exhibits the spring or buffering action. The deformation of the rubber ring 10 buffers the relative displacement between the outer housing 9 and the center core 11 in the longitudinal direction within a horizontal plane. According to the construction described above, however, the center line of each of the outer housing 9 and the center core 11 is disposed vertically in order to accurately locate the wheel-and axle 6 to the truck frame 3. This construction is light in weight and simple as a journal box support structure. When the truck runs on a curved track, however, the steering function of the wheel-and-axle 6 is nothing but tread force steering effected by the padient of the wheel tread, and the steering quantity brought forth by this tread force steering is not sufficient. Particularly when the truck runs on the curved track at a high speed, the flange wear of the wheel and the wear of the rail increase.

In order to eliminate the problem described above, a steering truck has been developed which has a construction such that the truck is caused to rock in such a direction so as to bring the center line of the wheel-and-axle 6 of the truck into agreement with the center of radius of curvature of a curved track when the truck runs on the curved track. For example, in Japanese Patent Publication No. 11538/1980 (corresponding to U.S. Pat. No. 3,948,188) a truck is proposed wherein the portions of the truck frame corresponding to the side frames consist of swing arms. When the truck runs on a curved track, the load-bearing capacities change at both side positions of the truck. That is, a large load acts on the outer rail side of the truck and the load drops on the inner rail side. This change of load-bearing capacities causes the swing arms to rock, and the angle of inclination of the swing arm changes. Thus, the wheel base of the truck is extended or contracted due to the rock of the swing arm, thereby effecting the steering operation.

In accordance with this construction, however, the axle spring must be composed of a laminated spring, but this laminated spring might impede comfortability design. When a driving bogie equipped with a motor is to be produced, it becomes difficult to support the motor because the construction of the truck frame is not a rigid frame bogie, and hence the construction might become complicated.

Another steering truck is described in Japanese patent Publication No. 20562/1973 and Japanese Utility Model Publication No. 24097/1973 wherein the journal box is mounted to the truck frame by supporting leaf springs or links, with the supporting leaf springs or links being fitted in such a fashion that they are inclined when the truck runs on an ordinary linear track. The angle of inclination of the supporting leaf springs or links is changed by the change of load-bearing capacities at the right and left positions of the truck when it runs on a curved track. The change of the angle of inclination in turn extends or contracts the wheel base, thereby effecting the steering operation of the wheel-and-axle. Since the truck frame of this truck is a rigid truck frame, no problem occurs, in particular, when a motor or the like is mounted to the truck to obtain a driving bogie. However, the journal box of this prior art truck must be located and fitted to the truck frame using the supporting leaf springs or links. Therefore, the number of necessary components and weight increase, and the cost of production is proportionately increased. In addition, inspection and maintenance becomes also more troublesome. In accordance with this construction, the journal box is moved within a horizontal plane by the elastic deformation of the supporting leaf springs resulting from the relative displacement between the journal box and the truck frame in the vertical direction, or by the rock of the links. The movement of the journal box within the horizontal plane causes the steering operation of the wheel-and-axle. In the steering operation of the wheel-and-axle described above, the supporting leaf springs or links rotate with a certain point being the center, and hence the orbit of relative movement of the journal box to the truck frame describes an arc. In order to obtain the optimal steering operation of the wheel-and-axle, however, the orbit of relative movement of the journal box to the truck frame must be linear so that steering is proportional to the change of the load-bearing capacities at the right and left positions of the truck frame. If the journal box is mounted to the truck frame by the supporting leaf springs or links as in the prior art truck, the orbit of relative movement of the journal box to the truck frame becomes an arc as described above, and the optimum steering operation can not be accomplished. Though this disadvantage might be solved by increasing the radius of rotation of the supporting leaf springs or links, this makes it difficult, in turn, to reduce the size or weight of the truck.

SUMMARY OF THE INVENTION

The present invention relates to a truck for a railway vehicle which can exhibit the optimum steering operation of a wheel-and-axle by a simple construction and can solve the problems of the prior art trucks described above.

In a truck for a railway vehicle comprising a plurality of wheels-and-axles disposed in parallel with one another, journal boxes disposed on the wheels-and-axles, a truck frame around that point supported by the journal boxes on the wheels-and-axles and journal box locating means for locating the journal boxes to the truck frame, a truck for a railway vehicle in accordance with one embodiment of the present invention is characterized in that the journal box and the truck frame have relative displacement in the vertical direction, the journal box locating means is disposed in such a fashion that the orbit of movement of the center of the journal box due to the relative vertical displacement described above within a vertical plane in the longitudinal direction of the truck expands upward with respect to the center axis of the truck, and the journal box locating means permits the relative displacement between the journal box and the truck frame by the elastic deformation of elastic members.

DESCRIPTION OF THE PREFERRED EMBODIMENTS

Hereinafter, preferred embodiments of the invention will be described in detail with reference to the accompanying drawings.

Figure 1:
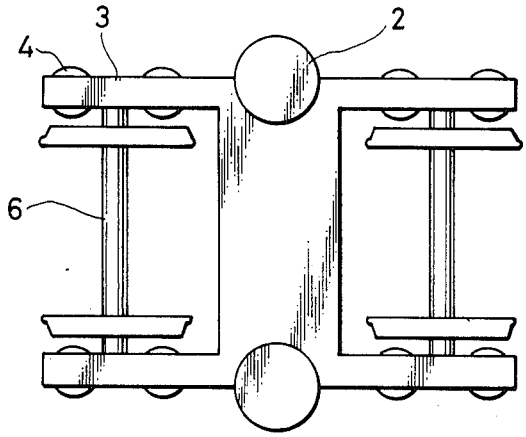
FIG. 1 is a plan view showing a conventional truck for a railway vehicle.
Figure 2:
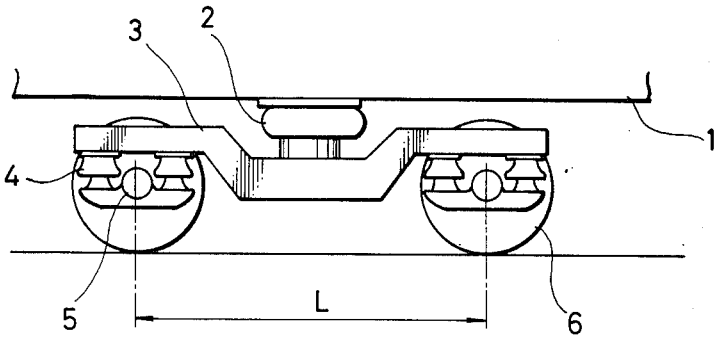
FIG. 2 is a side view of the truck shown in FIG. 1.
Figure 3:
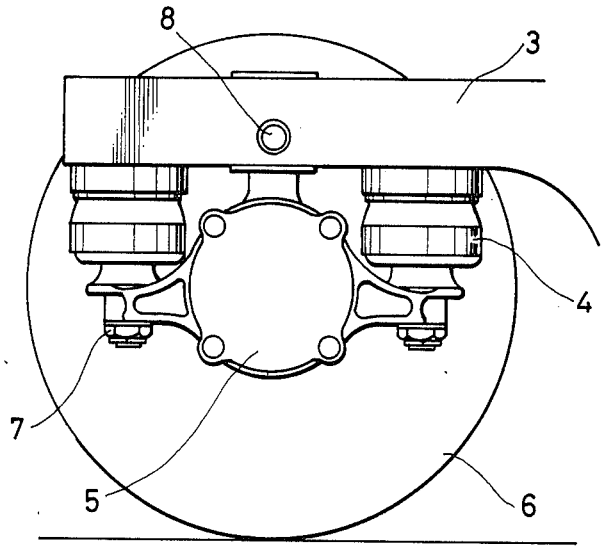
FIG. 3 is a front view of a journal box support portion of the truck shown in FIG. 2.
Figure 4:
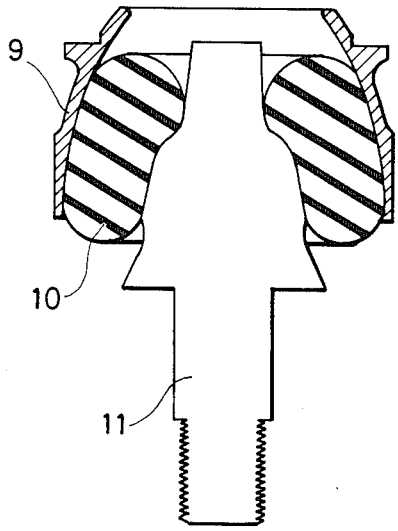
FIG. 4 is a sectional view of a journal box support device shown in FIG. 3.
Figure 5:
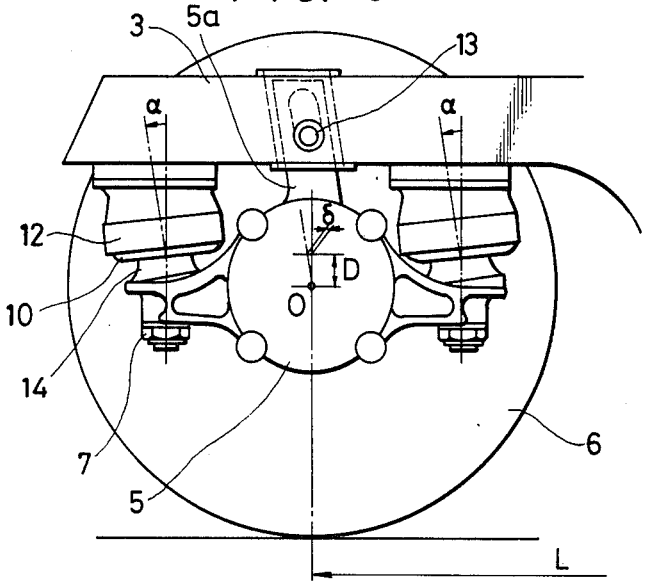
FIG. 5 is a front view of the journal box support portion in a truck for a railway vehicle in accordance with one embodiment of the present invention.
Figure 6:
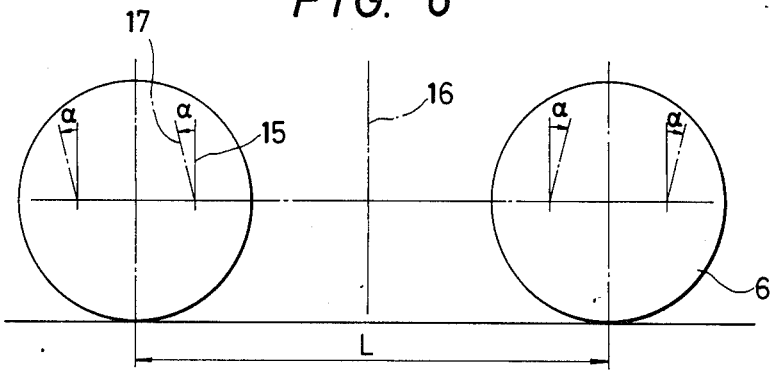
FIG. 6 is a side view showing the journal box support construction of the truck shown in FIG. 5.
Figure 7:
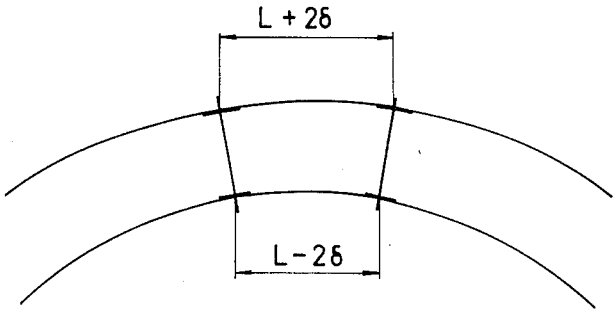
FIG. 7 is a plan view showing the state of a wheel-and-axle when the truck shown in FIG. 5 is running on a curved track.

Referring now to FIGS. 5, 6 and 7, wherein like reference numerals are used, to identify like parts as in the prior art truck, an outer housing 12, having the same shape as the outer housing 9 of the prior art truck, is mounted to a truck frame 3 in such a fashion that its center axis is inclined at an angle $\alpha$ with respect to the center line of the truck in the longitudinal direction of the truck within a perpendicular plane to the truck center line.

In a construction in which an axle box hanger **5*a* disposed on the journal box 5 is inserted into a hole of a truck frame 3, a set metal 13 permits relative vertical motion between the axle box hanger 5*a* and the truck frame 3, and prevents the axle box hanger 5*a* from falling off from the hole of the truck frame 3. The axle box hanger 5*a* and the hole of the truck frame 3 into which the former is inserted are disposed with their center axis being inclined at the angle $\alpha$ in the same way as the outer housing 12. Center cores 14 are fitted by nuts 7 on both sides of the journal box 5 in the longitudinal direction of the truck, and are inserted into the outer housings via rubber rings 10, respectively. Each center core 14 is disposed with its center axis being inclined at the angle $\alpha$ in the same way as the outer housing 12**.

Next, the arrangement of the outer housings 12 and center cores 14 of the front and rear wheels-and-axles of the truck will be described with reference to FIG. 6. As shown in FIG. 6, the truck has a vertical center line 16, and a rolling rubber center line 17 which represents the center axis of each of the outer housing 12 and center core 14. Reference numeral 15 is a vertical center line of the position at which the center core 14 is disposed. As shown in FIG. 6, the rolling rubber center axis 17 is inclined outward by the angle $\alpha$ with respect to the vertical center line 15 within the vertical plane in the longitudinal direction of the truck. When a load to be borne by the journal box 5 changes and vertical displacement occurs vertically between the journal box 5 and the truck frame 3, this arrangement of the journal box 5 lets the moving orbit of the journal box 5 with respect to the truck frame 3 expand upward within the vertical plane with respect to the truck center line 16.

When a vehicle equipped with the truck described above enters the curved track, surplus centrifugal force acts upon the vehicle. In this case, the car body undergoes a rolling towards the outer rail side due to the surplus centrifugal force. The load acting upon journal box locating means, which comprises the outer housing 12 on the inner rail side of the truck, the rubber ring 10 and the center core 14, decreases due to the rolling of the car body. As the load-bearing capacity thus changes, the journal box 5 undergoes relative displacement by a dimension D with respect to the truck frame 3 due to the change of the load-bearing capacity as shown in FIG. 5 which illustrates the journal box support portion on the outer rail side of the truck. As the rubber ring 10 undergoes bending in this case, movement described above is effected. Relative displacement occurs between the truck frame 3 and the journal box 5, but since the journal box 5 is fitted to the truck frame 3 by the journal box locating means comprising the outer housing 12, the rubber ring 10 and the center core 14 on the rolling rubber center line arranged at the angle of inclination $\alpha$, it moves outward in the longitudinal direction of the truck by a distance $\delta$ as shown in FIG. 5.

On the other hand, the load-bearing capacity decreases for the journal box support portion on the inner rail side of the truck opposite to the outer rail side shown in FIG. 5. Therefore, the gap between the truck frame 3 and the journal box 5 becomes great and the journal box 5 moves in the longitudinal direction of the truck. When the vehicle runs on the curved track described above, therefore, the journal L becomes greater by $2\delta$ on the outer rail side of the truck as shown in FIG. 7, and becomes smaller by $2\delta$ on the inner rail side.

That is, the journal between the wheels-and-axles is $L+2\delta$ on the outer rail side and is $L-2\delta$ on the inner rail side of the truck, and the steering operation of each wheel-and-axle 6 is effected.

According to the construction described above, the load-bearing capacity changes due to the surplus centrifugal force acting upon the car body when the vehicle runs on the curved track, at each of the right and left positions of the truck, so that each wheel-and-axle 6 carries out its steering operation. Therefore, the flange wear of the wheel-and-axle 6 as well as the rail wear can be reduced. This construction can be accomplished extremely easily by merely inclining the rolling rubber cener line 17 of the journal box locating means consisting of the outer housing 12, the rubber ring 10 and the center core 14, and the workability of inspection and maintenance can be improved. Since the number of components can be reduced, the weight of the truck can be also reduced advantageously.

In the construction described above, the truck frame 3 is a rigid truck frame so that a motor can be mounted to the truck frame 3 without any problem, in particular, and the truck frame can be used as a driving bogie. Since the moving orbit of the journal box 5 with respect to the truck frame 3 due to the relative displacement between the truck frame 3 and the journal box 5 is linear, a problem does not occur in that the steering quantity of the wheel-and-axle 6 deviates from the optimal state due to the change of the load-bearing capacity.

Figure 8:
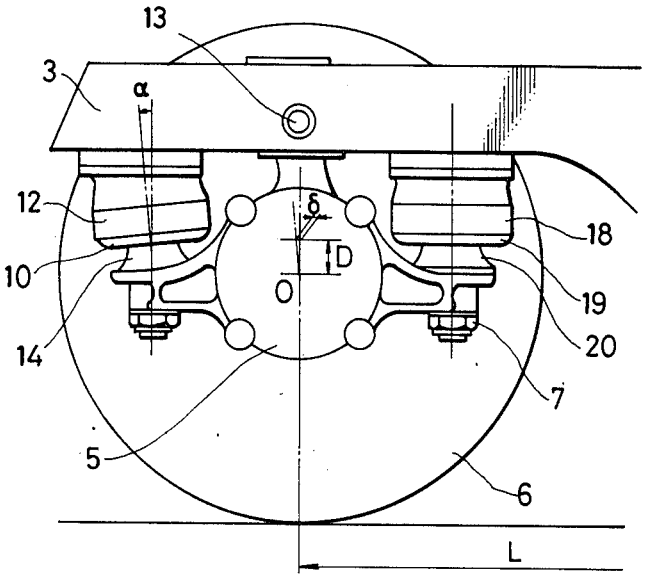
FIGS. 8, 9, 10 and 11 are front views, each showing the journal box support portion in a truck for a railway vehicle in accordance with other embodiments of the present invention.

The embodiment of FIG. 8 differs from the foregong embodiment of FIGS. 5–7 in that the rolling rubber center line of one set of outer housing 18, rubber ring 19 and center core 20 disposed at the front or rear of the journal box 5 is aligned perpendicularly.

According to the construction described above, the operating condition of each portion when the vehicle runs on the curved track is the same as that in the foregoing embodiment, and the steering operation of the wheel-and-axle 6 can be accomplished.

In the construction described above, the operating directions of the support portions at the front and rear of the journal box 5 are different, so that the rigidity of the journal support can be diversified by the combination of the rubber rings 10 and 19 having various properties, and optimal dimensions can be selected.

Figure 9:
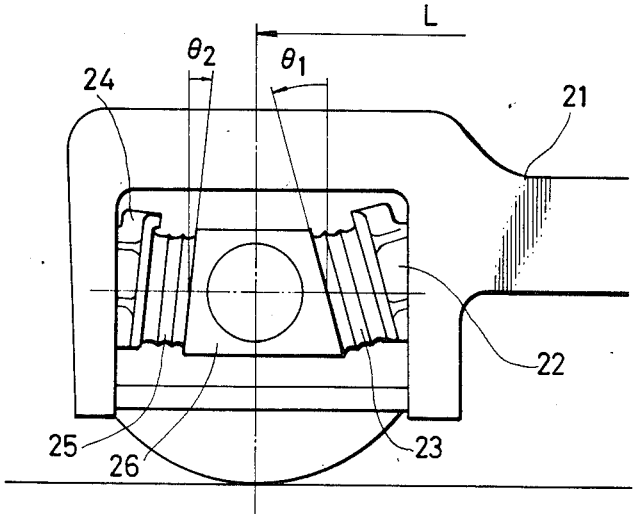

In the embodiment of FIG. 9, a truck frame 21 has ⊐-shaped portions at the positions where the journal boxes 26 are not mounted, in order to receive chevron rubber supports 22 and 24, respectively. Reference numerals 23 and 25 represent chevron rubbers that are disposed between the chevron rubber supports 22, 24 and the journal box 26. Among the chevron rubbers 23 and 25, the chevron rubber 23 disposed near the center of the truck is fitted with an angle of inclination $\theta_1$, while the chevron rubber 25 towards the end of the truck is fitted with an angle of inclination $\theta_2$. The angle of inclination $\theta_1$ is greater than $\theta_2$. When the load-bearing capacity changes due to the difference of these angles of inclination $\theta_1$ and $\theta_2$ at the right and left positions of the truck, the component of force of the chevron rubber 23 in the longitudinal direction of the truck is greater than that of the chevron rubber 25, and the journal box 26 can be moved in the longitudinal direction of the truck.

When the vehicle equipped with the truck which includes the journal box locating means consisting of the chevron rubber supports 22, 24 and the chevron rubbers 23, 25 runs on the curved track, the load-bearing capacity changes at the right and left positions of the truck due to the surplus centrifugal force acting upon the car body. The chevron rubbers 23 and 25 undergo deformation due to the change of the load-bearing capacity as described already, the journal box 26 on the inner rail side moves towards the center of the truck and the journal box 26 on the outer rail side moves towards the end of the truck. In other words, each wheel-and-axle 6 effects steering as shown in FIG. 7.

According to the construction described above, the steering of each wheel-and-axle 6 can be effected during the running of the vehicle on the curved track by the simple construction in which the inclined angle of disposition of the chevron rubbers 23, 25 of the truck using them is changed as described above. Since the truck frame 21 is a rigid bogie in the same way as in the foregoing embodiments, it can be used as a driving bogie.

Figure 10:
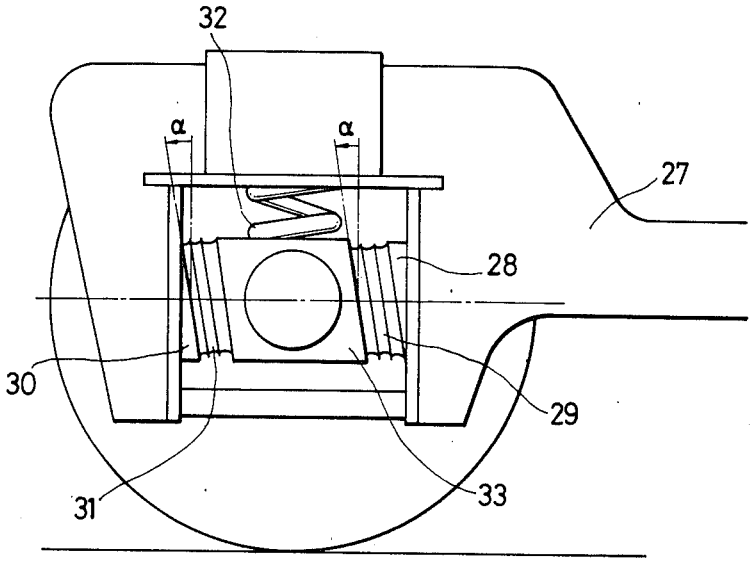

In the embodiment of FIG. 10, a truck frame 27 is equipped with a ⊐-shaped support guide portion at the support position for each journal box. The rubber supports 28 and 30 are disposed at the support guide portion of the truck frame 27, and laminate rubbers 29 and 31 are disposed between the rubber supports 28, 30 and the journal box 33. The laminate rubbers 29 and 31 are disposed at an angle of inclination $\alpha$ which expands upward within a vertical plane relative to the truck center line. An axle spring 32 is disposed between the upper surface of the journal box 33 and the upper side of the support guide portion of the truck frame 27. The axle spring 32 transmits the load between the truck frame 27 and the journal box 33 in the vertical direction.

When the vehicle, in which the truck having the journal box locating means comprising the rubber support 28, the laminate rubber 29 and the axle spring 32 supports the car body, runs on the curved track, the load-bearing capacity changes at the right and left positions of the truck due to the surplus centrifugal force acting upon the car body. The axle spring 32 undergoes deformation due to the change of the load-bearing capacity, and the laminate springs 29 and 31 also undergo deformation. Since the load-bearing capacity decreases on the inner rail side of the truck, the axle spring 32 is elongated and the laminate rubbers 29 and 31 move the journal box 33 towards the center of the truck. Since the load-bearing capacity increases on the outer rail side of the truck, the axle spring 32 undergoes contraction and the laminate rubbers 29 and 31 move outward the journal box 33 in the longitudinal direction of the truck.

According to the construction described above, the load-bearing capacity at the right and left positions of the truck changes due to the surplus centrifugal force acting upon the car body when the vehicle runs on the curved track, as described already. The deflection quantities of the axle springs 32 at the right and left positions of the truck also change due to the change of the load-bearing capacity. This means that the gap between the journal box 33 and the truck frame 27 in the vertical direction changes, and this change moves the journal box 33 and permits the wheel-and-axle to cause the steering operation. Therefore, the flange wear of the wheel-and-axle or the rail wear can be reduced. In this construction, the vertical load is borne by the axle springs 32 so that a great load is not applied to the laminate rubbers 39 and 31. In other words, large and expensive laminate rubbers capable of withstanding a great load are not necessary.

Figure 11:
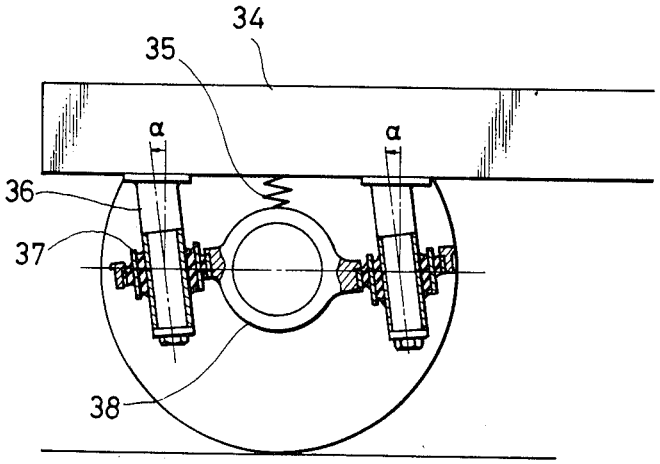

In the embodiment of FIG. 11, a truck frame 34 is provided, with an axle spring 35 disposed between the truck frame 34 and the journal box 38. A center core 36 is fitted with the angle $\alpha$ at the front and rear of the journal box 38 of the truck frame 34. A cylindrical rubber 37 is fitted to the center core 36 and is coupled with the journal box 38 on its outer circumference. In this construction, the load in the vertical direction is transmitted from the truck frame 34 to the journal box 38 via the axle spring 35, and relative movement between the truck frame 34 and the journal box 38 in the vertical direction is allowed by the center core 36 and the cylindrical rubber 37. The journal box 38 is guided by the center core 36.

When the vehicle, whose car body is supported by the truck having the journal box locating means comprising the axle spring 35, the center core 36 and the cylindrical rubber 37, runs on the curved track, the load-bearing capacity changes at the right and left positions of the truck due to the surplus centrifugal force acting upon the car body, and the axle springs 35 undergo deflection due to this change. Then, the gap between the truck frame 34 and the journal box 38 changes due to this deflection of the axle spring 35. On the other hand, since the journal box 38 is guided by the center core 36 which is fitted with the angle of inclination $\alpha$, the journal box 38 rocks the wheel-and-axle in the longitudinal direction of the truck due to the change of the gap between the truck frame 34 and the journal box 38 and permits it to cause the steering operation.

The construction described above permit the wheel-and-axle to cause the steering operation when the vehicle runs on the curved track, by the simple construction that the center core 36 which guides the vertical movement of the journal box 38 with respect to the truck frame 34 is disposed with the angle of inclination $\alpha$. This construction can also reduce the flange wear of the wheel-and-axle and the rail wear. The construction of the truck frame 34 is simple, and its production is easy.

As described above, the present invention can cause the steering operation of the wheel-and-axle by the simple construction, and can drastically reduce the flange wear of the wheel-and-axle and the rail wear.

What is claimed is:

1. A truck for a railway vehicle comprising a plurality of wheels-and-axles spaced from each other in the longitudinal direction of the truck; journal boxes disposed on said wheels-and-axles, at both ends thereof; a truck frame supported by said plurality of wheels-and-axles via said journal boxes; and journal box locating means for locating said journal boxes with a gap provided in a vertical direction from said truck frame, through elastic members affect laterally from an associated one of said journal boxes and permitting relative displacement between each of said journal boxes and said truck frame in the longitudinal, the lateral, and in the vertical directions of said truck due to elastic deformation of said elastic members, wherein said journal box locating means locates said journal boxes with respect to said truck frame in such a fashion that the distance between said journal boxes on one side of said vehicle disposed in the longitudinal direction of said truck is expanded in linear proportion to a reduction of said gap in the vertical direction while the distance between said journal boxes on another side of said vehicle disposed in the longitudinal direction of said truck is decreased in linear proportion to an increase of said gap in the vertical direction.

2. A truck for a railway vehicle comprising a plurality of wheels-and-axles spaced from each other in the longitudinal direction of the truck; journal boxes disposed on said wheels-and-axles, at both ends thereof; a truck frame supported by said plurality of wheels-and-axles via said journal boxes; and journal box locating means for locating said journal boxes with a gap provided in the vertical direction from said truck frame through elastic members, and for permitting relative displacement between each of said journal boxes and said truck frame in the longitudinal, the lateral, and the vertical directions of said truck due to elastic deformation of said elastic members, each of said journal box locating means includes center cores disposed at both sides of each of said journal boxes in the longitudinal direction of said truck and installed in such a fashion that the axes of said center cores are inclined from the vertical axis so as to have upper ends of said axes extending toward said truck frame in a direction remote from the center line of said truck in the longitudinal direction of said truck, rubber rings into each of which each of said center cores is inserted, and outer housings each of which is mounted on a bottom of said truck frame with said rubber rings being inserted between said outer housings and said center cores and which outer housings are inclined in the same fashion as said center cores.

3. A truck for a railway vehicle comprising a plurality of wheels-and-axles spaced from each other in the longitudinal direction of the truck; journal boxes disposed on said wheels-and-axles, at both ends thereof; a truck frame supported by said plurality of wheels-and-axles via said journal boxes; and journal box locating means for locating said journal boxes with a gap provided in the vertical direction from said truck frame through elastic members, and for permitting relative displacement between each of said journal boxes and said truck frame in the longitudinal, the lateral, and the vertical directions of said truck due to elastic deformation of said elastic members, wherein said locating means includes a pair of elastic members of a chevron rubber type disposed on both sides of said journal box in the longitudinal direction in such a manner that each of said elastic members is inclined toward the center line of each of said journal boxes in the direction of the truck frame, and the angle of inclination of one elastic member located on the side nearer the center of said truck is greater than that of the other elastic member located on the side nearer to the end of said truck.

* * * * *